US008108952B2

(12) United States Patent
Hsiao

(10) Patent No.: US 8,108,952 B2
(45) Date of Patent: Feb. 7, 2012

(54) CONTROLLING APPARATUS FOR AUTOMATED TOILET SEAT AND LID LIFTING AND CLOSING DEVICE

(76) Inventor: Po-Sen Hsiao, Taoyuan (TW)

( * ) Notice: Subject to any disclaimer, the term of this patent is extended or adjusted under 35 U.S.C. 154(b) by 734 days.

(21) Appl. No.: 12/260,087

(22) Filed: Oct. 28, 2008

(65) Prior Publication Data

US 2010/0101009 A1 Apr. 29, 2010

(51) Int. Cl.
*A47K 13/10* (2006.01)

(52) U.S. Cl. ..... 4/246.1; 4/234

(58) Field of Classification Search ..... 4/246.1, 4/234

See application file for complete search history.

(56) References Cited

U.S. PATENT DOCUMENTS

| | | | | |
|---|---|---|---|---|
| 6,450,886 | B1 * | 9/2002 | Oishi et al. | 463/36 |
| 6,707,386 | B1 * | 3/2004 | Pruisner | 340/665 |
| 6,969,579 | B1 * | 11/2005 | Kitson et al. | 430/271.1 |
| 2004/0078880 | A1 * | 4/2004 | Hewton | 4/246.1 |

* cited by examiner

*Primary Examiner* — Gregory Huson
*Assistant Examiner* — Karen L Younkins

(57) ABSTRACT

A controlling apparatus for automated toilet seat and lid lifting and closing device is provided, including a mat, at least a detection module, and a control module. The detection module is located inside the mat. The control module is electrically connected to the detection module and an automated toilet seat and lid lifting and closing device, respectively. The mat is placed in front of the toilet. When a user steps on the mat, the detection module and the control module detects the orientation and position of the footprint to determine whether the user is facing or facing away from the toilet and sends control signals to the automated toilet seat and lid lifting and closing device to operate accordingly. Also, the detection module can detect the user finishing using the toilet and leaving the mat, a corresponding signal is sent to the automated toilet seat and lid lifting and closing device to close the lid and flush.

9 Claims, 10 Drawing Sheets

CONTROLLING APPARATUS FOR AUTOMATED TOILET SEAT AND LID LIFTING AND CLOSING DEVICE

FIELD OF THE INVENTION

The present invention generally relates to a controlling apparatus for automated toilet seat and lid lifting and closing device, and more specifically to a controlling apparatus for controlling the lifting and closing of the automated toilet seat and lid device according to the orientation and position of the soles of the feet.

BACKGROUND OF THE INVENTION

The common household toilet is the European toilet, i.e., for sitting, instead of squatting. Therefore, a common argument is whether the toilet seat and lid should stay lifted or closed, and which user (the male or the female) is responsible for lifting and closing. Also, an even more common complaint is that many users consider lifting and closing the toilet seat or lid inconvenient or unhygienic.

Some designs are developed to solve the aforementioned inconvenience, for example, the use of spring to make the toilet seat automatically lifted when not pressed. While the spring-based lifting device saves the users from the act of lifting, the female user or the male user for the excretion purpose must hand-press the toilet seat before using the toilet. Another concern is that it may be considered not hygienic keeping the toilet lid lifted while flushing after using the toilet as the swirl caused by the flushing may carry the microbes or bacteria in the excretion or urine in the air. Also, a closed lid may reduce the flushing noise.

SUMMARY OF THE INVENTION

The present invention is to provide a controlling apparatus for automated toilet seat and lid lifting and closing device. The controlling apparatus of the present invention is of the shape of a mat, placed in front of the toilet so that when a user stands on the mat in front of the toilet, the controlling apparatus can detect whether the user is standing facing or back to the toilet. By detecting the user's standing direction, the controlling apparatus sends a single to control the automated toilet seat and lid lifting and closing device to behave accordingly. Therefore, when the user stands facing the toilet, the controlling apparatus sends the signal to the automated toilet seat and lid lifting and closing device to lift the toilet seat and lid. When the user stands back to the toilet, the controlling apparatus sends the signal to the automated toilet seat and lid lifting and closing device to lift the lid, but keep the toilet seat down. When the user leaves the mat, the controlling apparatus sends the signal to the automated toilet seat and lid lifting and closing device to close the toilet seat and lid and flush. Hence, the user only needs to walk to the toilet and stand on the mat, or walk to the toilet and turn around and stand on the mat, the controlling apparatus can automatically control the lifting and closing of the toilet seat and lid.

To achieve the above object, the present invention provides a controlling apparatus for automated toilet seat and lid lifting and closing device, including a mat, at least a detection module, and a control module. The detection module is located inside the mat. The control module is electrically connected to the detection module and an automated toilet seat and lid lifting and closing device. The detection module includes a plurality of detection circuits. Each detection circuit can output a voltage signal according to the point where in the circuit the user steps on and applies the force. The control module includes a control comparison circuit. After receiving the voltage signals from the plurality of detection signals, the control comparison circuit can determine and output signals to the automated toilet seat and lid lifting and closing device to activate certain operations, such as lifting lid only, lifting both toilet seat and lid, or closing the toilet seat and lid and flushing.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein:

FIG. 2 shows a schematic view of the theory the present invention being based on;

DETAILED DESCRIPTION OF THE PREFERRED EMBODIMENTS

Figure 1:
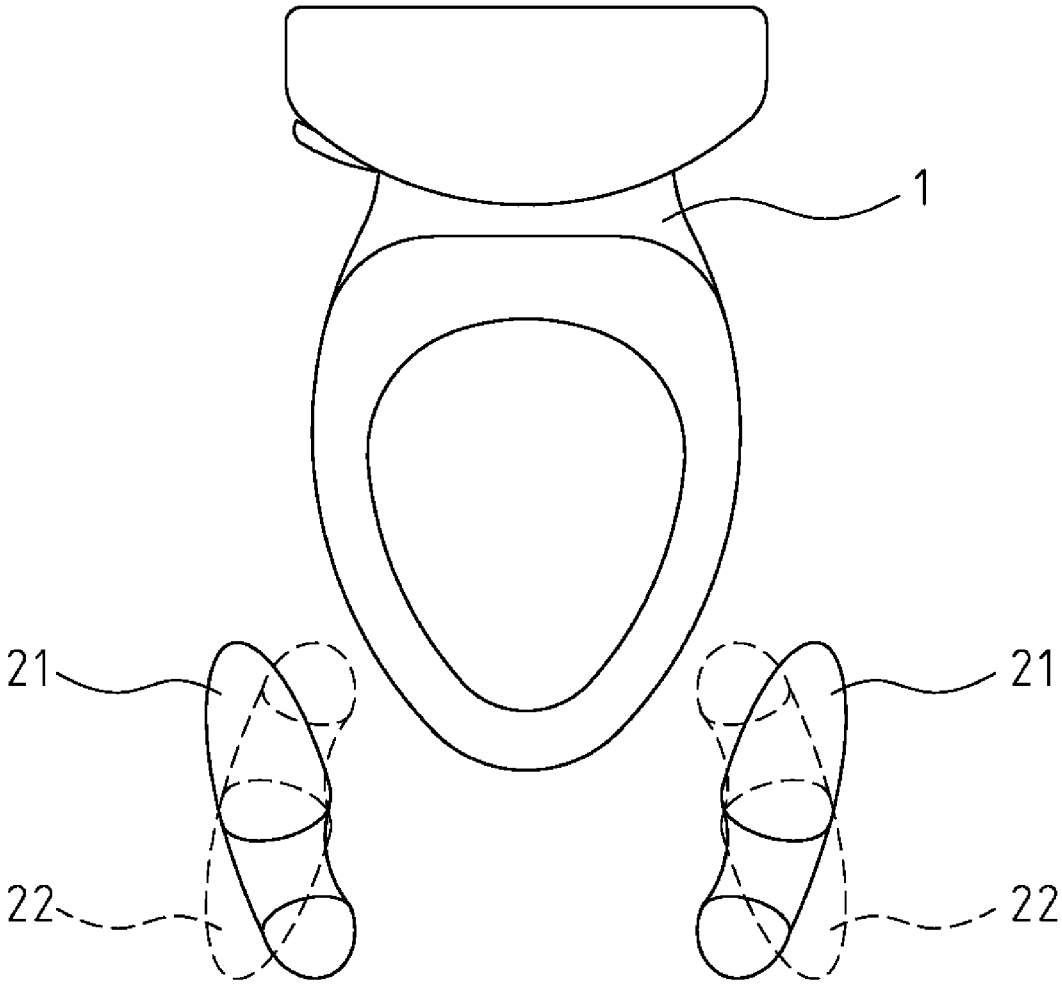
FIG. 1 shows a schematic view of the footprint when a user using a toilet.

FIG. 1 shows an exemplary use of the theory on which the present invention is based. As shown in FIG. 1, when a user stands to urinate, the user must face a toilet 1. Because the majority of the users are slightly out-toeing (i.e., when standing, the distance between the tips of the soles of the feet is slightly more apart than the heels of the soles of the feet, the footprint will be as solid footprint 21 shown in FIG. 1. When a user uses toilet 1 by sitting, the user must turn his/her back to toilet 1, and then sit down on toilet 1. The footprint of a user sitting will be as dotted footprint 22 shown in FIG. 1.

Figure 2:
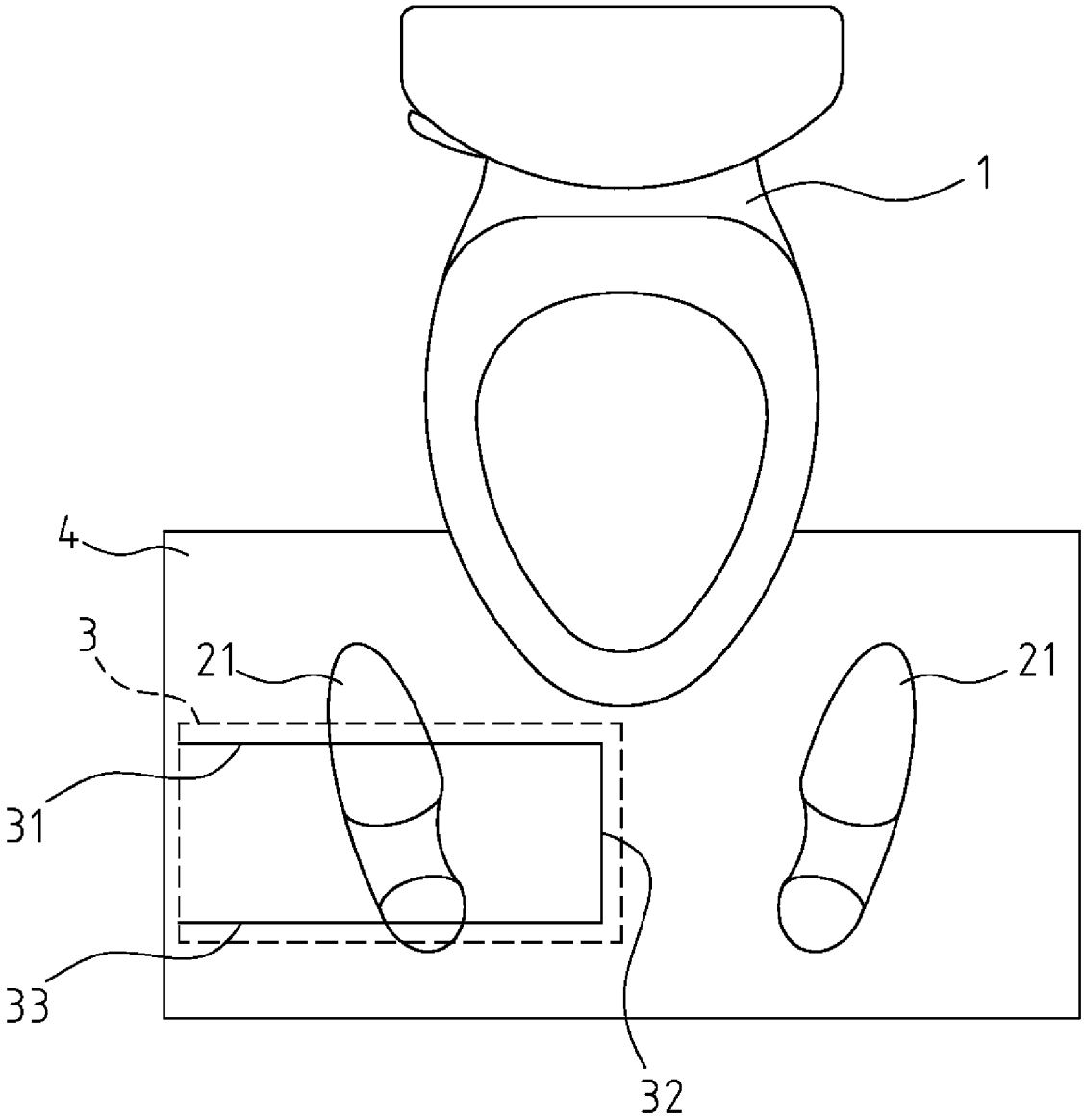

FIG. 2 shows a schematic view of the detection theory of the present invention. A mat 4 is placed in front of toilet 1. A circuit 3 including three segments arranged as the letter "E" with missing the center stroke is located on either left or right half of mat 4. FIG. 2 shows the detection circuit on the left half of mat 4 when facing toilet 1, and the orientation of letter "E" with missing stroke is mirrored. A circuit 3 includes a first detection line 31, a base line 32 and a second detection line 33. When the footprint of the user is footprint 21, the footprint steps on first detection line 31 and second detection line 33. As the majority of the users are slightly out-toeing as aforementioned, when the user stands with footprint 21, the step point on first detection line 31 has a longer distance to base line 32 than the step point on second detection line 33 to base line 32. Similarly, when the footprint of the user is footprint 21, the footprint steps on first detection line 31 and second detection line 33. As the majority of the users are slightly out-toeing as aforementioned, when the user stands with footprint 22 (facing from the toilet), the step point on first detection line 31 has a shorter distance to base line 32 than the step point on second detection line 33 to base line 32. Therefore, the present invention uses the distances between the step points to the base line to determine whether the user is facing or facing from the toilet. The actual determining mechanism is using the distance to change the output voltage of the circuits.

Figure 3:
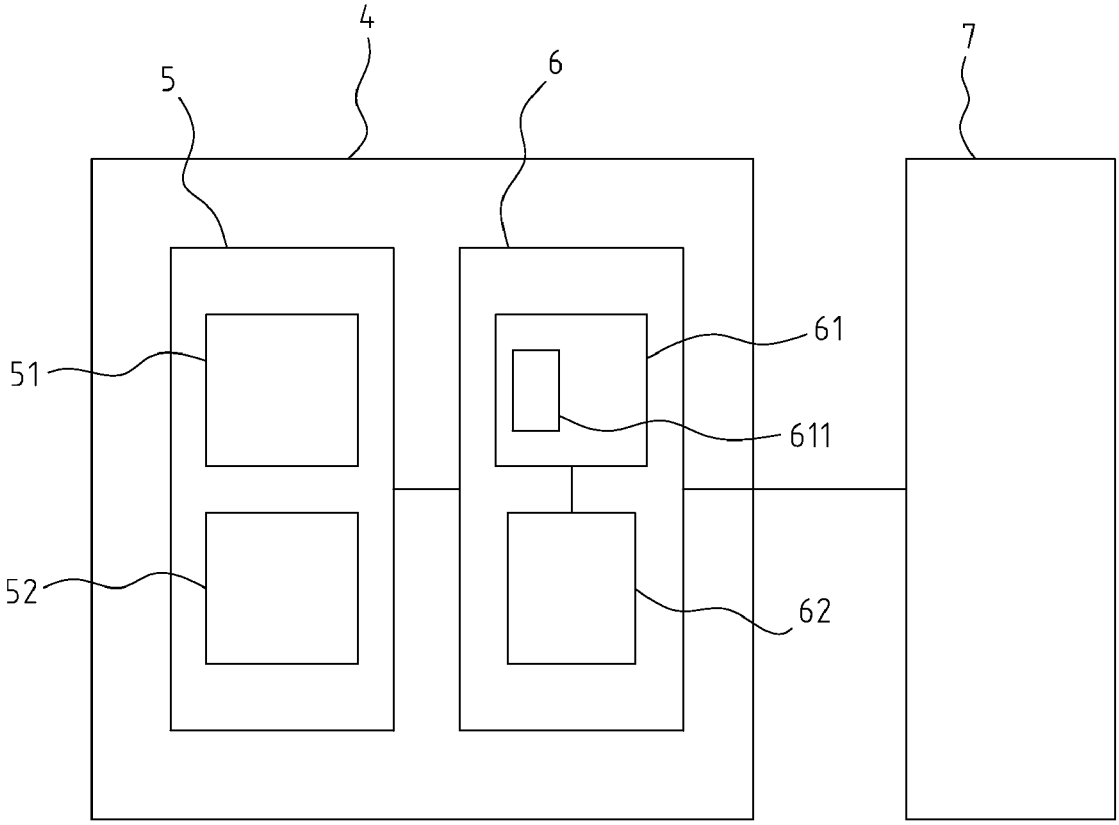
FIG. 3 shows the block diagram of the present invention.

FIG. 3 shows a schematic view of the block diagram of the present invention. A controlling apparatus of the present invention includes a mat 4, at least a detection module 5 and a control module. Detection module 5 is located inside mat 4. Control module 6 is electrically connected to detection module 4 and an automated toilet and lid lifting and closing device 7, respectively. Detection module 5 includes a plurality of detection circuits. The present embodiment includes two detection circuits, first detection circuit 51 and second detection circuit 52. Each detection circuit 51, 52 will output a voltage signal when the detection circuit is stepped upon, and the voltage is related to the point at which the detection circuit is stepped upon. Control module 6 includes a control comparison circuit 61 for receiving voltage signals from the plurality of detection circuits, determining and outputting appropriate control signal to automated toilet seat and lid lifting and closing device 7 to activate corresponding actions.

Figure 4:
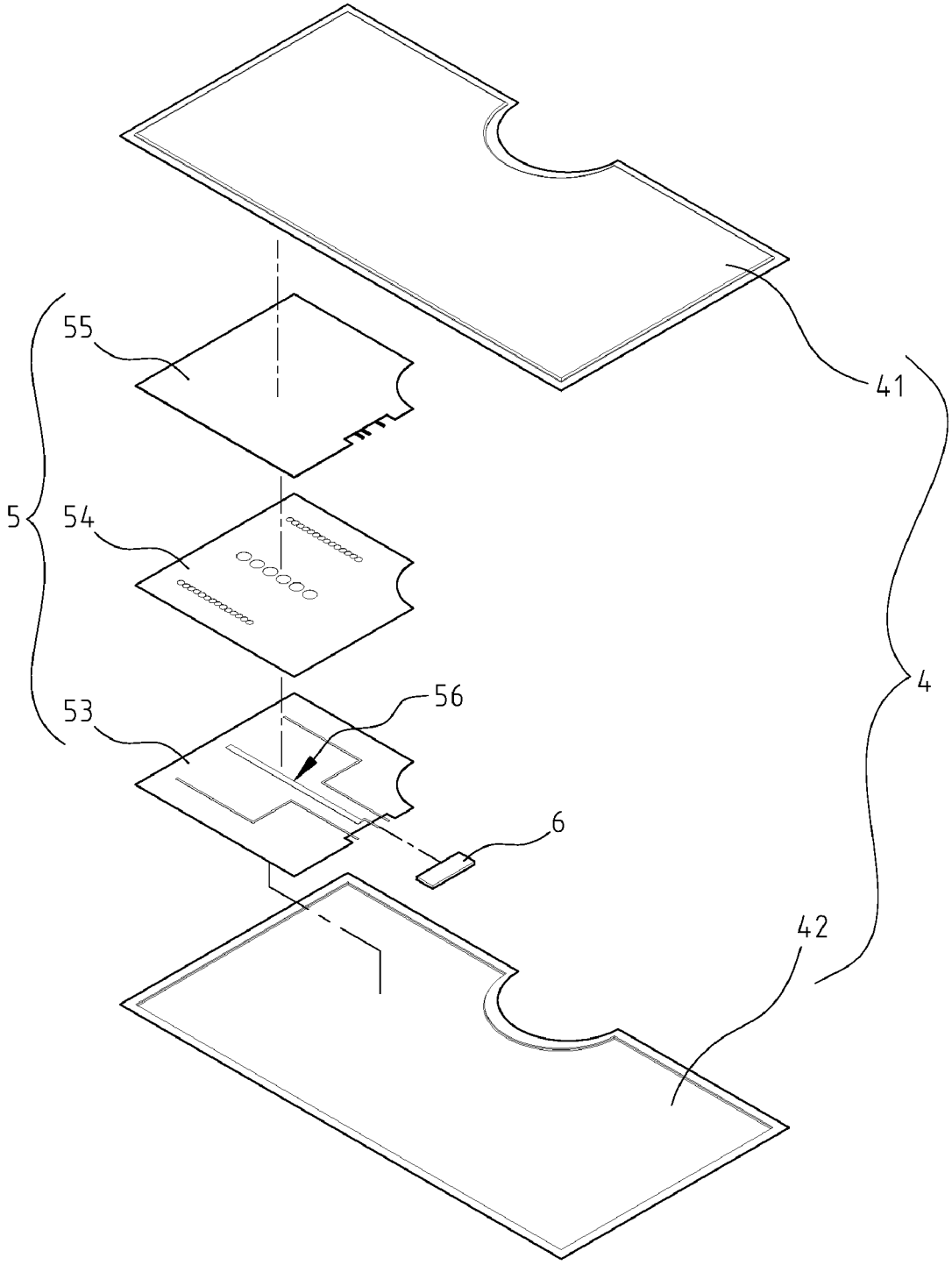
FIG. 4 shows a dissected view of the embodiment of the present invention.

FIG. 4 shows an exemplar embodiment of the present invention. In this embodiment, mat 4 includes a mat cover upper layer 41 and a mat cover lower layer 42. Detection module 5 and control module 6 are embedded inside mat 4. In this embodiment, detection module 5 includes 3 layers of soft plates, from the bottom up, lower layer plate 53, insulation layer plate 54 and upper layer plate 55. The related circuits of aforementioned first detection circuit 51 and second detection circuit 52 are formed on aforementioned lower layer plate 53 and upper layer plate 55. Detection module 5 further includes a switch circuit 56 for switching on/off the operation of detection module 5. The related circuits of switch circuit 56 are also formed on aforementioned lower layer plate 53 and upper layer plate 55.

Figure 5:
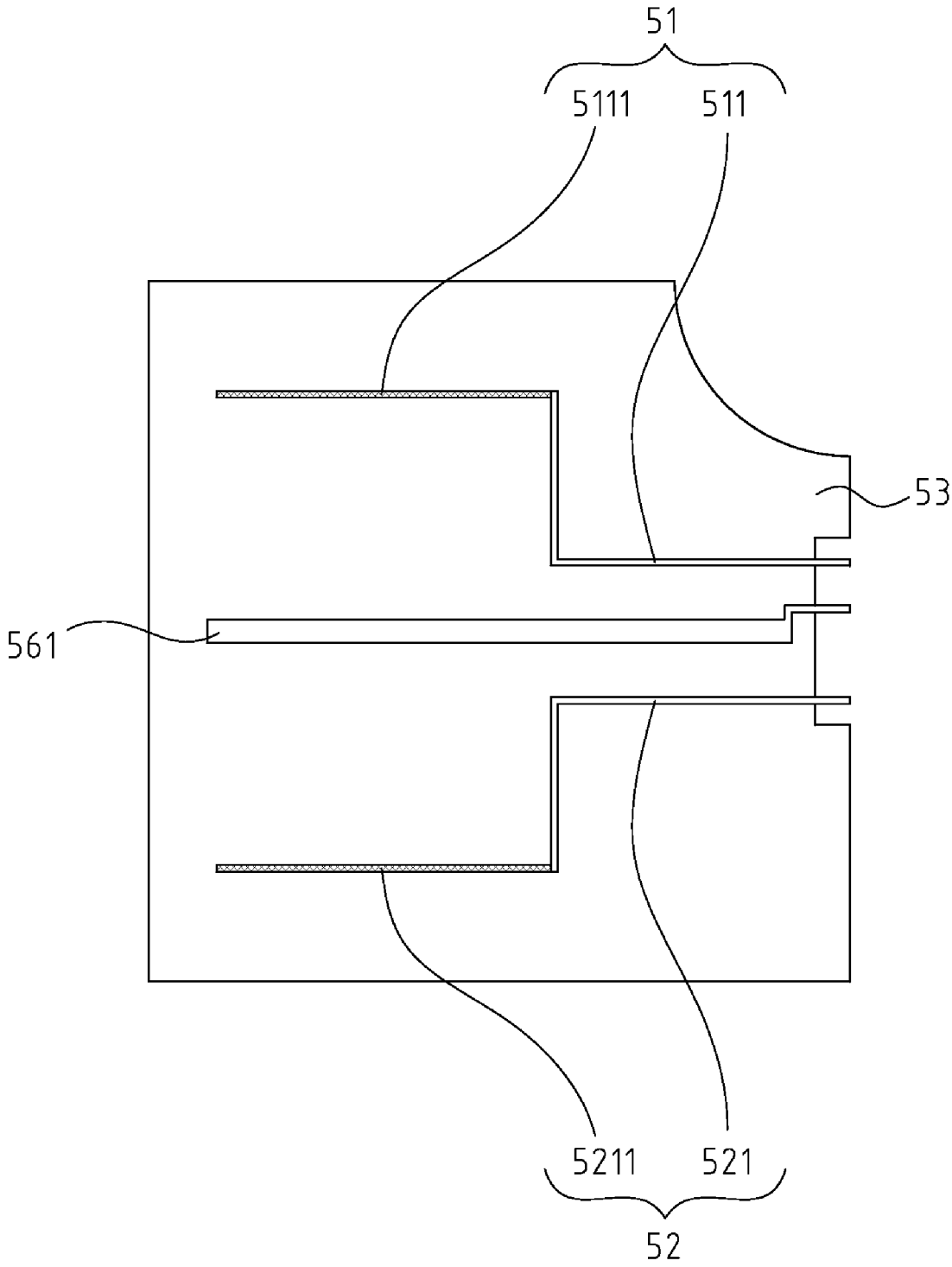
FIG. 5 shows a schematic view of an embodiment of the lower layer plate of the detection module according to the present invention.

As shown in FIG. 5, lower layer plate 53 is located at the bottom, with an upward surface having a lower layer circuit 511 of first detection circuit 51, a first switch circuit 561 of switch circuit 56 and a lower layer circuit 521 of second detection circuit 52. A part of lower layer circuit 511 and lower layer circuit 521 is made of high impedance conductive material, namely, resistor segment 5111 and resistor segment 5211. Resistor segments 5111, 5211 are positioned in parallel with each other.

Figure 6:
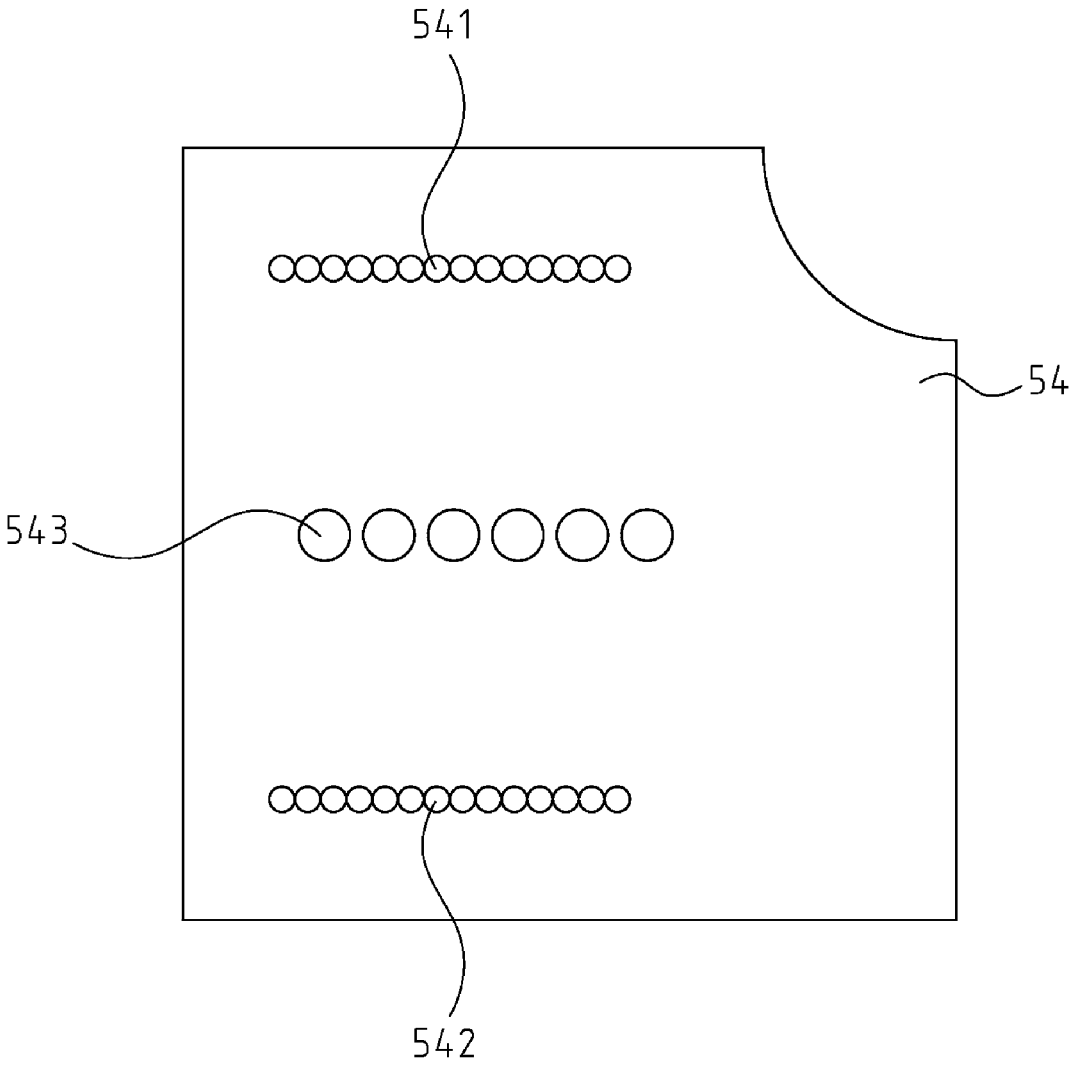
FIG. 6 shows a schematic view of an embodiment of the insulation layer plate of the detection module according to the present invention.

As shown in FIG. 6, insulation layer plate 54 is located in the middle layer, made of an insulation plastic sheet. Insulation layer plate 54 includes a plurality of circuit contact holes, 541, circuit contact holes 542 and switch circuit contact holes 543. The locations of aforementioned contacts are different.

Figure 7:
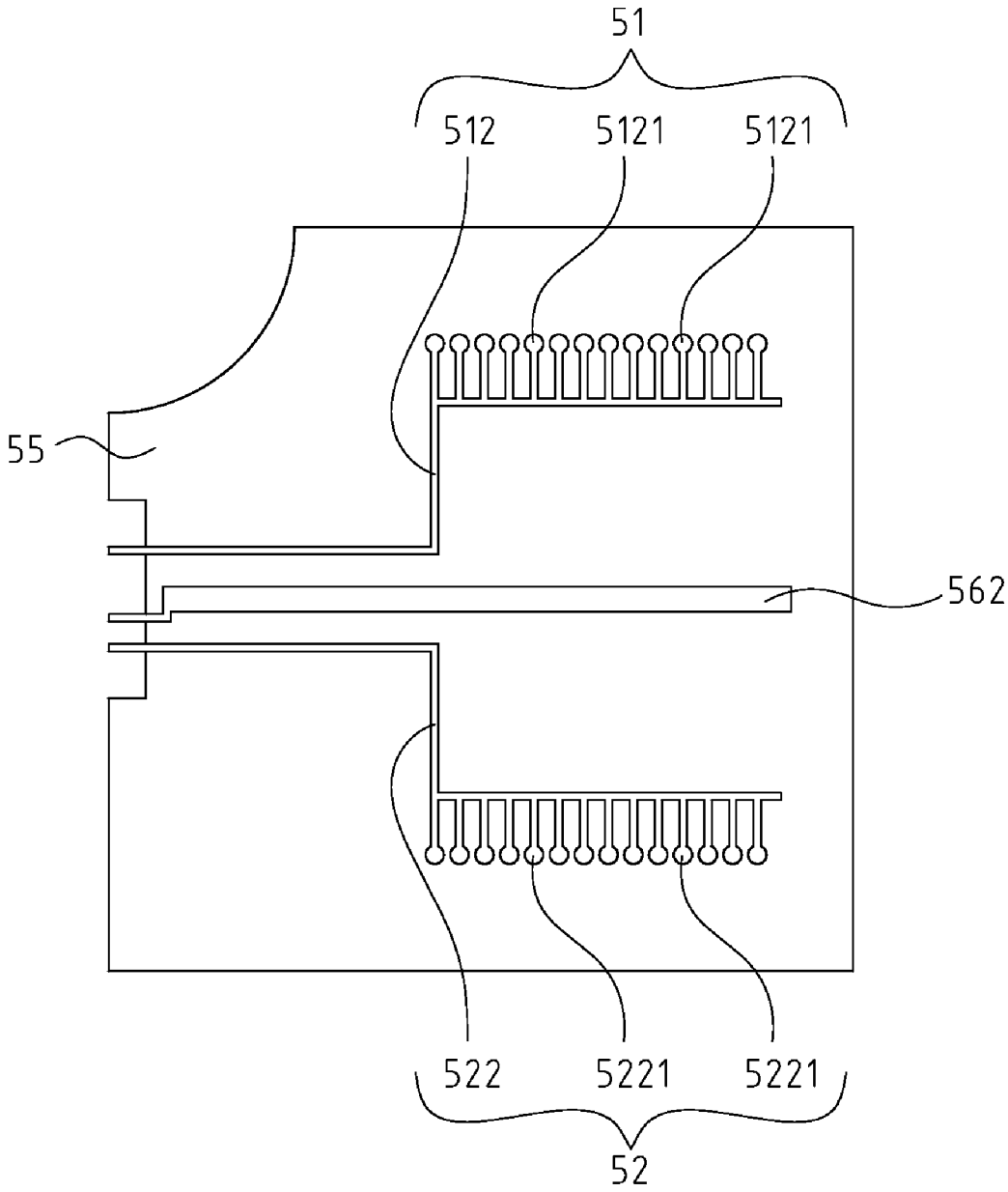
FIG. 7 shows a schematic view of an embodiment of the upper layer plate of the detection module according to the present invention.

As shown in FIG. 7, upper layer plate 55 is located at the top, with a downward surface having an upper layer circuit 512 of first detection circuit 51, a second switch circuit 562 of switch circuit 56 and an upper layer circuit 522 of second detection circuit 52. Upper layer circuit 521 and upper layer circuit 522 include a plurality of contact elements 5121, 5221. The locations of contact elements 5121 are corresponding to aforementioned circuit contact holes 541 and resistor segment 5111. The locations of contact elements 5221 are corresponding to aforementioned circuit contact holes 542 and resistor segment 5211.

When mat 4 is stepped on, upper layer plate 55 is pressed and contact elements 5121 will contact resistor segment 5111 through circuit contact holes 541 so that first detection circuit 51 will form a circuit loop and output a voltage signal. Similarly, contact elements 5221 will contact resistor segment 5211 through circuit contact holes 542 so that second detection circuit 52 will form a circuit loop and output a voltage signal.

As shown in FIG. 3, control module 6 further includes a control comparison circuit 61 and a timer 62. Control comparison circuit 61 includes at least a comparator 611 for receiving and comparing voltage signals from first detection circuit 51 and second detection circuit 52. Control comparison circuit 62 further includes other logic circuits for determining and outputting a control signal to automated toilet seat and lid lifting and closing device 7 according to the output from comparator 611, or using timer 61 to activate automated toilet seat and lid lifting and closing device 7 to operate after an appropriate duration. For example, control module 6 can be set to perform the detection and voltage signal comparison after the step is stabilized or after a period of delay to avoid transient error caused by unstable steps. Control module 6 can also be set to send a signal to close the lid and flush after detection the disappearance of the steps and a period of appropriate delay in order to determine that the user has finished using the toilet.

Figure 8A:
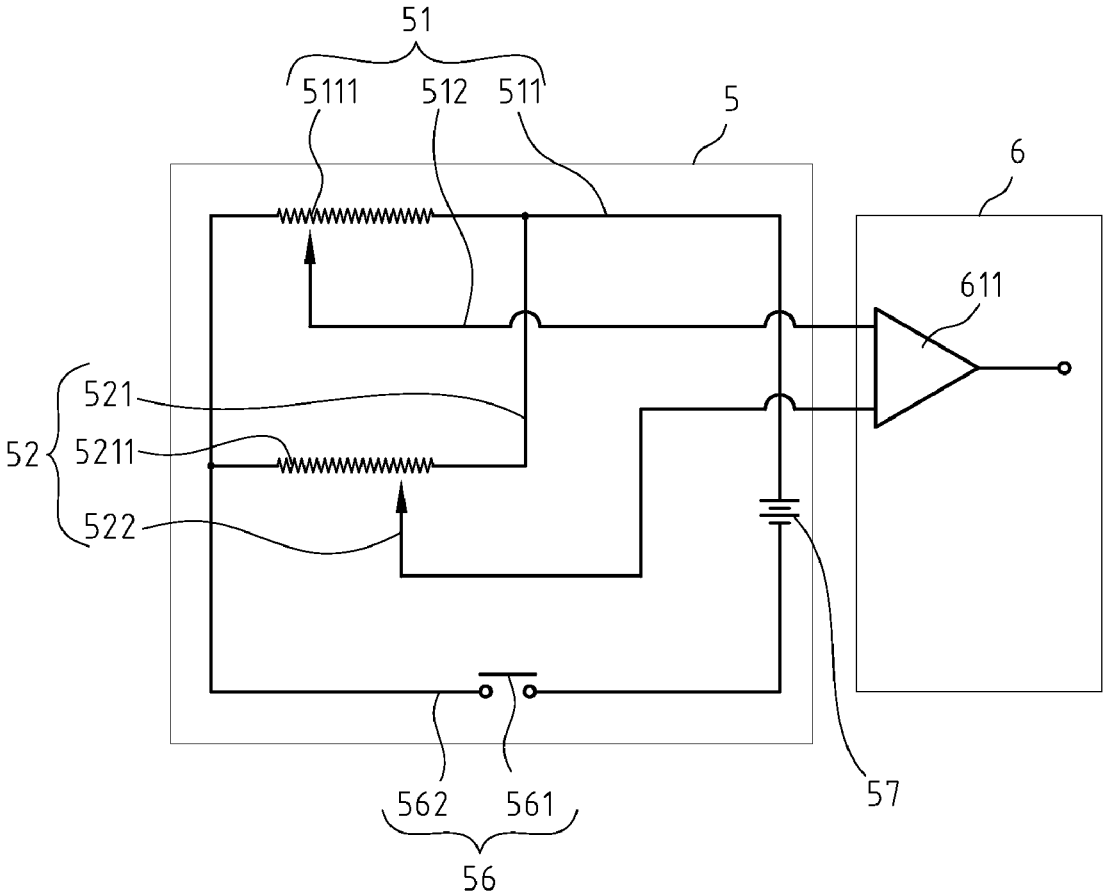
FIG. 8A shows a schematic view of an embodiment of the circuit of the present invention.
Figure 8B:
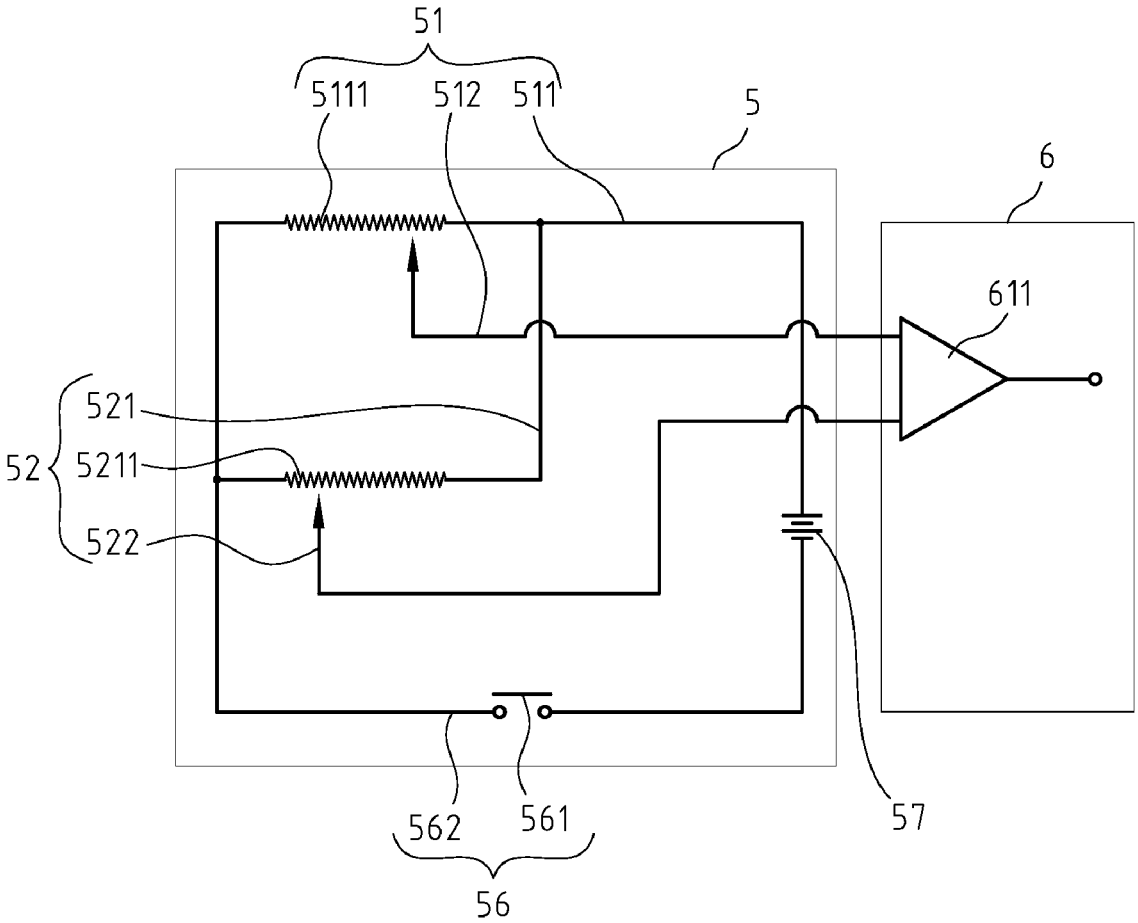
FIG. 8B shows a schematic view of an embodiment of the circuit of the present invention.

FIGS. 8A and 8B show a schematic view of the exemplary circuit of the present invention, including a part of circuits of detection module 5 and control module 6. First switch circuit 561 and second switch circuit 562 are designed as the switch of detection module 5. When the user steps on mat 4 to cause the connection of switch circuit 56, the power is turned on. In this embodiment, detection module 5 further includes a power unit 57. Power unit 57 can be a battery to provide the power for the operation of detection module 5 and control module 6. Alternatively, detection module 5 and control 6 can also draw power from automated toilet seat and lid lifting and closing device 7 directly.

The present invention uses resistor segments 5111, 5211 as variable resistors. According to the distances between step points on the circuits and the non-resistor segment of lower layer circuits 511, 521, the resistance of the circuit segment can be determined. As shown in FIG. 8A, when the user is facing the toilet, the current passing through first detection circuit 51 (i.e., lower layer circuit 511, resistor segment 5111, and upper layer circuit 512) experiences a resistance higher than the passage through second detection circuit 52 (i.e., lower layer circuit 521, resistor segment 5211 and upper layer circuit 522). Therefore, the voltage signal transmitted through upper layer circuit 512 to comparator 611 is higher than upper layer circuit 522, and the comparison result is a low output. On the other hand, as shown in FIG. 8B, when the user is facing away from the toilet, the current passing through first detection circuit 51 experiences a resistance lower than the passage through second detection circuit 52. Therefore, the voltage signal transmitted through upper layer circuit 512 to comparator 611 is lower than upper layer circuit 522, and the comparison result is a high output.

Figure 9:
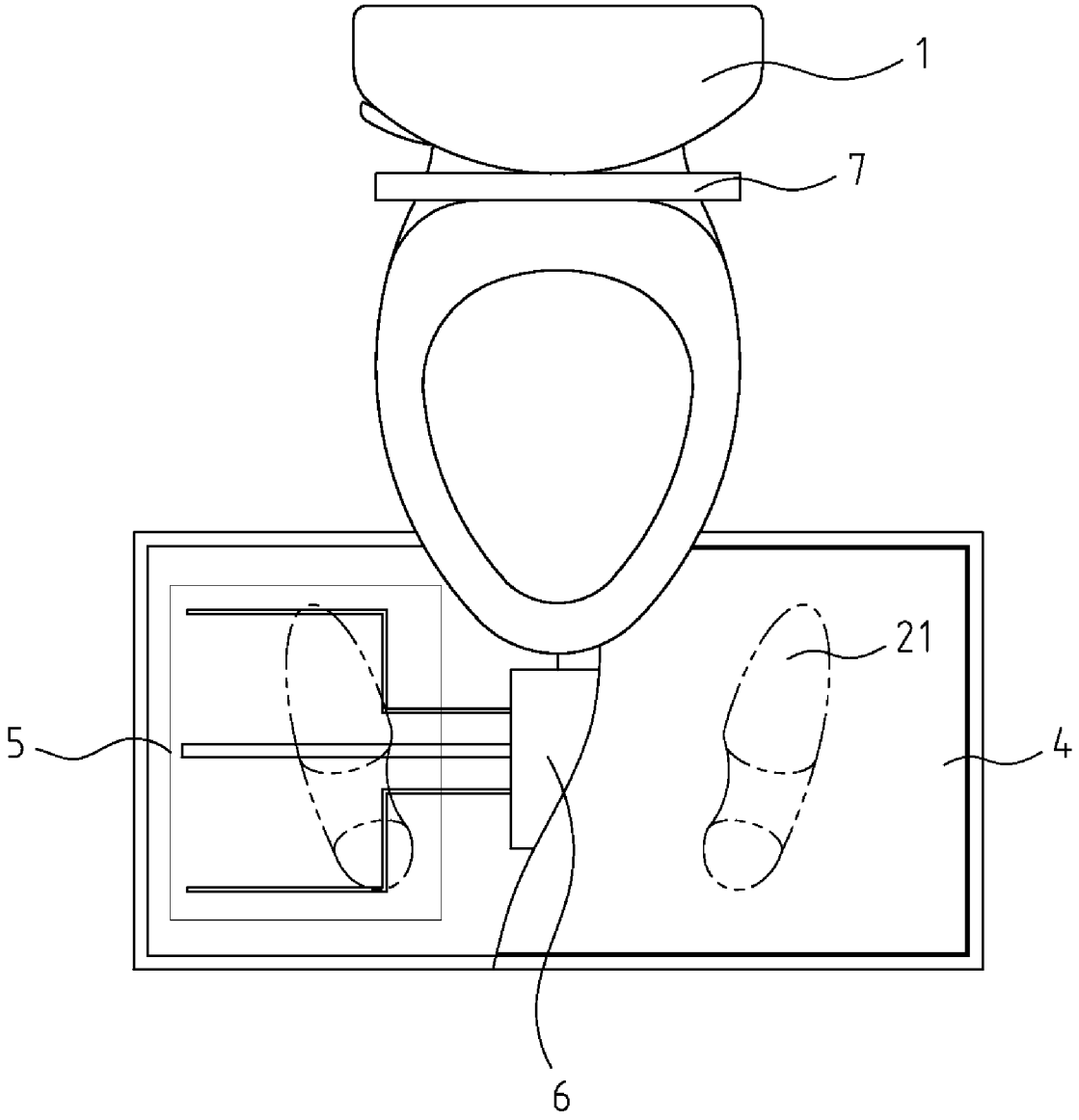
FIG. 9 shows an actual application of the present invention applied to a toilet.

FIG. 9 shows a schematic view of the actual application of the present invention applied to a toilet 1. When a user walks to toilet 1 and stands on mat 4 of the present invention, footprint 21 steps on the plurality of detection circuits of detection module 5 inside mat 4. Each detection circuit forms a loop at the step point and the switch circuit switches on the power. Control module 6 compares the voltage signals from detection module 5 and outputs control signals to automated toilet seat and lid lifting and closing device 7 to operate accordingly. Furthermore, if automated toilet seat and lid lifting and closing device 7 also includes an electronic flushing control device, control module 6 also sends a control signal to activate the flush when a user finishing using the toilet.

In the above embodiment, control module 6 is located inside mat 4. However, the present invention is not limited to the above embodiment. Control module 6 can be also located inside automated toilet seat and lid lifting and closing device 7 and is electrically connected to detection module 5 inside mat 4 through a connection wire.

In the above embodiment, detection module 5 is located on the left half of mat 4. However, the detection module can also be used on both halves to avoid erroneous interpretation. Alternatively, a single detection module 5 can be located on a half of mat 4 with the other half having a switch circuit 56 to ensure that the user has both feet standing in position for activating the detection execution.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A controlling apparatus for automated toilet seat and lid lifting and closing device, comprising:

a mat;

a detection module, located inside said mat, said detection module comprising a plurality of detection circuits, each said detection circuit outputting a corresponding voltage signal when stepped on; and a control module, electrically connected to said detection module and an automated toilet seat and lid lifting and closing device, respectively, said control module having a control comparison circuit for receiving said voltage signals from said detection circuits, and determining and outputting control signals to said automated toilet seat and lid lifting and closing device to operate accordingly.

2. The controlling apparatus as claimed in claim 1, wherein said plurality of detection circuits are positioned in parallel, each detection circuit comprises a lower layer circuit and an upper layer circuit, and said lower layer circuit and said upper layer circuit form a closed loop and output said voltage signal when stepped on and said upper layer circuit contacts said lower layer circuit.

3. The controlling apparatus as claimed in claim 1, wherein said control module further comprises a timer electrically connected to said control comparison circuit.

4. The controlling apparatus as claimed in claim 1, wherein said automated toilet seat and lid lifting and closing device further comprises an electronic flushing control device, and said control module can output a control signal to said electronic flushing control device to activate flushing.

5. The controlling apparatus as claimed in claim 1, wherein said detection module further comprises a switch circuit for switching on/off the operation of said detection module.

6. The controlling apparatus as claimed in claim 1, wherein said control module is located inside said mat.

7. The controlling apparatus as claimed in claim 1, wherein said control module is located inside said automated toilet seat and lid lifting and closing device.

8. The controlling apparatus as claimed in claim 1, wherein said detection module further comprises a power unit to provide power for the operation of said detection module and said control module.

9. The controlling apparatus as claimed in claim 1, wherein said detection module and said control module draw power from said automated toilet seat and lid lifting and closing device.

* * * * *